3/16/82 SR OR 4,320,403

United States Patent [19]

Ebneth et al.

[11] 4,320,403

[45] Mar. 16, 1982

[54] USE OF METALLIZED SHEET-FORM TEXTILE MATERIALS AS REFLECTION AND POLARIZATION CONTROL MEDIA FOR MICROWAVES

[75] Inventors: Harold Ebneth, Leverkusen; Hans-Georg Fitzky, Odenthal, both of Fed. Rep. of Germany

[73] Assignee: Bayer Aktiengesellschaft, Leverkusen, Fed. Rep. of Germany

[21] Appl. No.: 89,712

[22] Filed: Oct. 30, 1979

[30] Foreign Application Priority Data

Nov. 2, 1978 [DE] Fed. Rep. of Germany ..... 2847485

[51] Int. Cl.[3] ..... H01Q 19/195

[52] U.S. Cl. ..... 343/756; 343/909; 343/897

[58] Field of Search ..... 343/873, 915, 897, 909, 343/756; 427/162, 306, 404, 443.1

[56] References Cited

U.S. PATENT DOCUMENTS

| | | | |
|---|---|---|---|
| 2,447,380 | 8/1948 | Wenger | 427/404 |
| 2,534,710 | 12/1950 | Golian et al. | 343/915 |
| 2,750,321 | 6/1956 | Koppelman | 343/873 |
| 2,814,038 | 11/1957 | Miller | 343/915 |
| 2,936,453 | 5/1960 | Coleman | 343/915 |
| 3,967,010 | 6/1976 | Maekawa | 427/306 |
| 3,969,731 | 7/1976 | Jenkins et al. | 343/915 |
| 4,199,623 | 4/1980 | Nuzzi et al. | 437/443.1 |

FOREIGN PATENT DOCUMENTS

| | | | |
|---|---|---|---|
| 77382 | 10/1970 | German Democratic Rep. | 427/306 |

*Primary Examiner*—Eli Lieberman

*Attorney, Agent, or Firm*—Sprung, Felfe, Horn, Lynch & Kramer

[57] ABSTRACT

Metallized sheet-form textile materials of synthetic polymers or natural fibres, to which a metal layer has been applied by currentless wet-chemical deposition, are particularly suitable for use as reflectors for electromagnetic waves in the range from 10 MHz to 1000 GHz. In the case of stretched metallized fabrics, the reflecting radiation is partly polarized which can facilitate or improve the recognition of an object by radar beams. By periodically stretching and relaxing the fabric, it is even possible to modulate the reflected microwaves.

10 Claims, 4 Drawing Figures

USE OF METALLIZED SHEET-FORM TEXTILE MATERIALS AS REFLECTION AND POLARIZATION CONTROL MEDIA FOR MICROWAVES

BACKGROUND OF THE INVENTION

Position finding with radar is widely used, particularly in fog and other low-visibility weather conditions. It is desirable, particularly at sea, to be able to recognise even small objects (for example rescue islands, small boats, etc) at a range of up to about 10 km. However, position finding is complicated in heavy seas because water alone provides a relatively high reflection (approximately 50%) of radar waves. Accordingly, the objects in question are required to have a reflective power of at least 90%. In many cases, compact materials which reflect radar beams with minimal losses cannot be used for external applications. For technical or weight reasons, the outer wall of small objects at sea cannot be provided with a compact metallic surface.

SUMMARY OF THE INVENTION

An object of the present invention is to improve the recognisability of relatively small objects by radar beams, particularly at sea, in the air and in the rescue field. It has now been found that the recognisability of objects by radar, particularly of small objects, is improved if metallised sheet-form textile materials are applied to the objects, the metal having been applied to the sheet-form textile material after activation thereof in a total metal layer thickness of from 0.02 to 2.5 μm by currentless wet-chemical deposition. In the context of the invention, sheet-form textile materials are understood to be woven fabrics, knitted fabrics and non-woven fabrics. The invention relates to the use of metallised sheet-form textile materials as a reflecting material for microwave and decimeter wave radiation.

Polarisation of the radiation reflected by stretched metallised fabrics may be utilised to facilitate or improve object recognition. By periodic stretching and relaxation, it is possible to obtain a pulsating polarisation of the reflected microwaves.

It is of particular advantage that even thin metal layers have a sufficiently high reflective power. The surface conductivity of the sheet-form textile materials is considerably higher than it would be had the same amount of metal been applied by vapour deposition. Their surface resistance, as measured in accordance with DIN 54 345 at 23° C./50% relative humidity, is of the order of or less than $1.10^2\Omega$. It is surprising that even layer thicknesses in the region of skin depth still have a reflective power which would appear to be associated with the textile support. In the case of nickel layers for example, the skin depth is 0.27 μm at 3 GHz and 0.16 μm at 9 GHz.

The improved recognition even of small objects, achieved by the surface being covered at least partly by metallised sheet-form textile materials, increases safety, particularly at sea, in the air and in the rescue field.

One particular advantage of the use according to the invention is the lightness in weight and flexibility of the material. It may be attached to uneven surfaces and may be cut to any size. It is so light that the additionally applied material hardly affects the overall weight. It is a novel technique of increasing the reflective power of a non-metallic object for radar beams. The strength of the layer applied by currentless deposition is also higher than would be expected in the case of metal layer applied by vapour deposition. Further it is possible additionally to protect the metal layer by another protective layer applied for example by lacquering, lamination or coating. The reflective power is very high over a range of from 0.02 to 1000 GHz, i.e. over a considerably wider range than simply the "classical" radar range.

The sheet-form textile material may consist of cotton, polyacrylonitrile, polyamide, aramide, polyester, viscose, modacrylics, polyolefin, polyurethane, PVC either individually or in combination with one another. The metal layer applied by currentless deposition preferably consists of nickel, cobalt, copper, silver, gold, even in combinations or as an alloy.

The mesh width or crossing points of the weft and warp filaments of woven fabrics should be smaller than half the wavelength of the radiation to be reflected. It is preferred to use a sheet-form textile material of which the mesh width does not exceed one tenth of the wavelength. The reflection level is also governed by the form of the textile construction. Accordingly, an isotropic textile construction will be selected if the reflection is intended to be isotropic. Alternatively, it is possible, by applying tension, to obtain a looser, wider-mesh sheet-form textile material so that the microwave beams are partly polarised after reflection if the incident radiation is unpolarised or, where the incident radiation is linearly polarised, reflection is particularly high when the mechanical tension and the vector of the electrical field strenth are vertically superposed on one another.

DETAILED DESCRIPTION OF THE INVENTION

Figure 1:
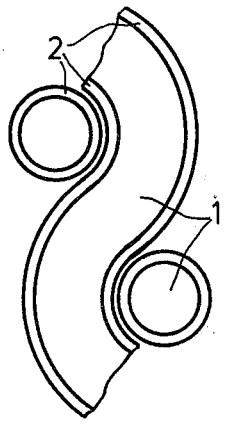
FIG. 1 is a schematic representation of two crossing fibers metallised according to the present invention.

In FIG. 1, a fiber 1 of polyacrylonitrile, polyamide or cotton, etc. has a coating 2 thereon formed by currentless wet chemical deposition. The coating 2 has a thickness of 0.02 to 2.5 μm and is substantially equally thick around the fiber. Between the fibers there is no agglutination of the fibers.

Figure 2:
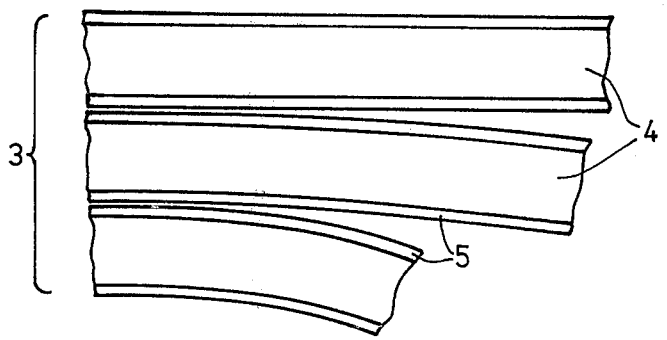
FIG. 2 is a schematic representation of parallel running filiments of a fiber thread metallised according to the present invention.

In FIG. 2, fiber thread 3 includes filaments 4 each coated with a metallised coating 5 by wet chemical currentless deposition. Each filament 4 has the coating 5 therearound, but the filaments 4 and not flued, that is, there is no coalescing.

The invention is illustrated by the following Examples:

EXAMPLE 1

A woven fabric of 100% polyacrylonitrile filament yarn has the following textile construction:

Warp and weft: 238 dtex (effective) of dtex 220 f 96 Z 150, 38.5 warp filaments/cm and 27 weft filaments/cm;

Weave: twill 2/2;

weight: 155 g/m$^2$.

It is immersed at room temperature in a hydrochloric acid bath (pH≦1) of a colloidal palladium solution according to German Auslegeschrift No. 1,197,720. After a residence time in the bath of up to about 2 minutes, during which it is gently moved, the fabric is removed and washed with water at room temperature. It is then immersed for about 1.5 minutes in a 5% sodium hydroxide solution at room temperature. The fabric is then washed with water at room temperature for about 30 seconds and subsequently introduced at room temperature into a solution consisting of 0.2 mole/l of nickel-II-chloride, 0.9 mole/l of ammonium hydroxide, 0.2 mole/l of sodium hypophosphite, into which ammonia is introduced in such a quantity that the pH-value at 20° C. is approximately 9.4. After only 10 seconds, the fabric begins to darken in colour through the deposition of nickel. After 20 seconds, the fabric floats to the top, giving off hydrogen gas, and even at this stage is completely covered with nickel. The material is left in the metal salt bath for about 20 minutes, removed, washed and dried.

During these 20 minutes, the material (dry weight 7.2 g) takes up about 3.1 g, i.e. approximately 40% by weight, of nickel metal. The rapid activatability and the high deposition of metal at room temperature are surprising. The nickel layer thickness on the fibre surface amounts to 0.77 μm .

Various sheet-form textile materials thickly coated with nickel were produced by the above-described process and the reflection losses between 2 and 25 GHz measured. The measuring process used is described for example in "Mikrowellenmeβtechnik" by H. Groll, F. Vieweg & Sohn, Brunswick, 1969, pages 353 et seq. The reflection loss is expressed in dB. To eliminate the effect of standing waves in the region before the object to be measured (interfacial reflection), a wide-band frequency-modulated radiation of constant power, for example 1.9 to 2.4 GHz, 7 to 8 GHz, is used.

| Nickel Layer Thickness in μm | Frequency range in GHz | | | |
|---|---|---|---|---|
| | 1.9–2.4 | 7–8 | 11–12 | 22–24.8 |
| 0.08 | 2.9 | 2.6 | 2.2 | 3.2 |
| 0.10 | 2.4 | 2.4 | 2.2 | 2.7 |
| 0.13 | 1.9 | 2.0 | 2.0 | 2.9 |
| 0.19 | 1.3 | 1.5 | 1.5 | 2.1 |
| 0.29 | 1.1 | 1.4 | 1.4 | 1.9 |
| 0.38 | 1.0 | 1.3 | 1.3 | 1.8 |
| 0.79 | 0.7 | 1.1 | 0.9 | 2.3 |

EXAMPLE 2

Reflection losses in dB on metallised sheet-form textile materials for oblique incidence:

The sheet-form textile materials used are the same as in Example 1; they are also coated with nickel in the say way as in Example 1. The incidence angle is 30°.

| Nickel layer thickness in μm | Frequency range in GHz | |
|---|---|---|
| | 7–8 | 11–12 |
| 0.08 | 1.0 | 1.2 |
| 0.10 | 1.5 | 1.1 |
| 0.13 | 1.1 | 1.0 |
| 0.19 | 0.4 | 0.4 |
| 0.29 | 0.4 | 0.4 |

-continued

| Nickel layer thickness in μm | Frequency range in GHz | |
|---|---|---|
| | 7–8 | 11–12 |
| 0.38 | 0.1 | 0.1 |

EXAMPLE 3

A coarse fabric woven from spun polyacrylonitrile fibres in linen weave with a large interval separating the crossing points between warp and weft filaments (1.5 mm gap between the two warp and weft filaments; 50.4 warp filaments/10 cm, 42.2 weft filaments/10 cm, L l/l) shows a reduction in reflection power with increasing frequency.

| Nickel layer thickness in μm | Frequency range in GHz | | | |
|---|---|---|---|---|
| | 1.7–2.4 | 7–8 | 11–12 | 23–24.5 |
| 0.2 | 0.7 | 1.0 | 1.2 | 3.2 |
| 0.78 | 0.3 | 0.9 | 1.1 | 2.4 |

Accordingly, dense fabrics are required for obtaining good reflection at short wavelengths.

EXAMPLE 4

Combination of two metal layers

A sheet-form textile material corresponding to Example 1 is coated as described in that Example with 0.2 μm thick nickel layer. Immediately after washing, it is introduced still wet into a gold cyanide bath at 78° C. The gold bath based on potassium gold cyanide (gold content 4 g/l) is adjusted with ammonia to a pH-value of 10.5. After 20 seconds, a metal film with a gold-like shine has been deposited onto the shining nickel layer. Within 5 minutes, the gold layer thickness on the nickel-coated surface amounts to 0.2 μm. The reflection losses in dB for vertical incidence are as follows:

| Layer thickness in μm | Frequency range in GHz | |
|---|---|---|
| | 1.7–2.4 | 23–24.5 |
| 0.2 Ni + 0.38 Au | 0.3 | 0.8 |

EXAMPLE 5

Figure 3:
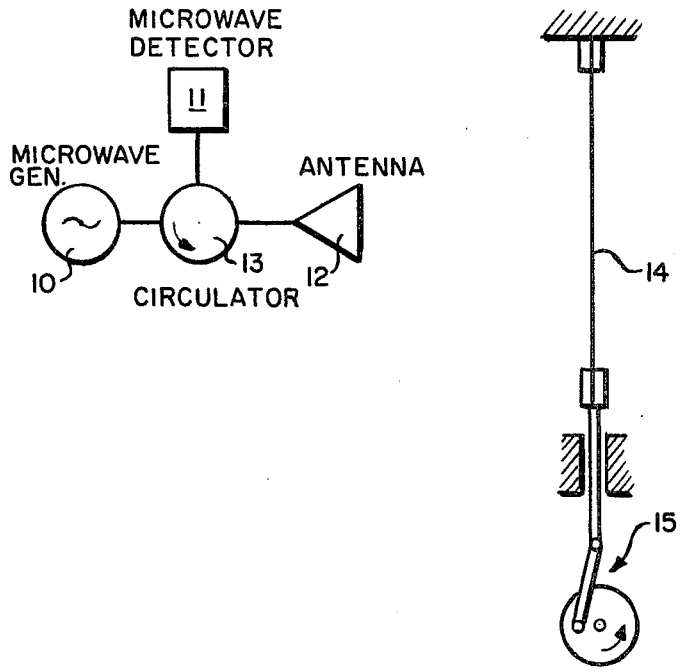
FIG. 3 is a schematic representation of one embodiment of a system using mechanically stressed fabric, metallised according to the present invention.
Figure 4:
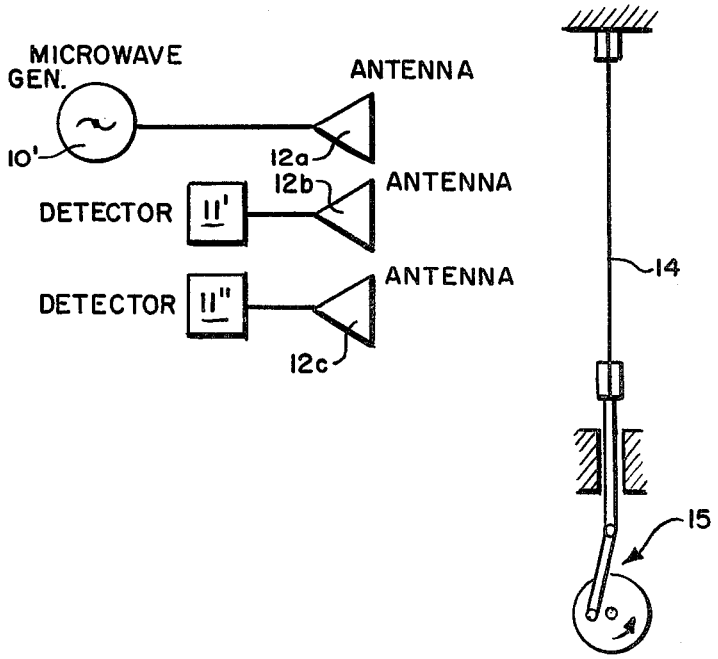
FIG. 4 is a schematic representation of another embodiment of a system using mechanically stressed fabric, metallised according to the present invention.

The reflection level depends on mechanical tensions as illustrated in FIGS. 3 and 4.

Linearly polarised microwave radiation impinges vertically on a knitted fabric 14 of an acrylonitrile copolymer on which a 0.75 μm thick nickel layer has been deposited. Line II shows the reflection losses in dB when the knitted fabric 14 is not subjected to mechanical tension. Line I shows the losses in the event of tensile stressing (tension direction parallel to the E-vector) by drive 15.

| | Frequency range in GHz | | | |
|---|---|---|---|---|
| | 1.7–2.4 | 7–8 | 11–12 | 23–24.5 |
| I | 0.9 | 0.8 | 1.3 | 3 |
| II | 2 | 1.3 | 2.6 | 6 |

A periodic variation in the tensile stress leads to a periodic variation in the reflected microwave intensity. In this way, it is possible to considerably increase the recognisability of an object being sought by radar in surroundings which reflect isotropically or at least constantly as a function of time (sea emergency rescue service, friend-foe recognition, etc). Either linearly polarised radiation generated by generator 10' through antenna 12*a* is used and the variation in intensity of the reflector evaluated by detectors 11', 11'' through antennae 12*b*, 12*c* as shown in FIG. 4 or circularly polarised radar beams created by generator 10 through circulator 13 and antenna 12 are used as shown in FIG. 3, in which case the reflected signal shows a periodic variation in the ellipticality of the polarisation which may be detected by an analyzer 11 through antenna 12 and circulator 13 at the receiving end.

EXAMPLE 6

A polyethylene paper, i.e. a non-woven material of polyolefin fibres, is provided as described above with a nickel layer applied by currentless deposition. For a 0.4 μm thick nickel layer, the reflection losses in dB are as follows:

| Frequency range in GHz | |
|---|---|
| 7–8 | 11–12 |
| 1.5 | 0.9 |

This metallised sheet-form textile material is particularly suitable for use as a recognition material, for example in the form of a cross for searching helicopters. By virtue of its light weight, it may be conveniently be taken on expeditions.

EXAMPLE 7

A blended polyester/cotton fabric consisting of 65% by weight of polyester staple fibres based on polyethylene terephthalate and 35% by weight of cotton shows the following reflection losses in dB for a 0.7 μm thick nickel layer:

| Frequency range in GHz | | |
|---|---|---|
| 1.7–2.4 | 7–8 | 11–12 |
| 0.7 | 0.7 | 0.7 |

This metallised material is suitable for tents, rucksacks or articles of clothing for skiers and walkers. The weight of the fabric is only negligibly increased by metallisation; it does not lose any of its textile-elastic properties. It it is coated with a layer of flexible PVC to make it rainproof, it may additionally be provided with warning colours. Persons carrying rucksacks or wearing articles of clothing such as these can be located by radar should they lose their way in desert regions or in the tundra.

EXAMPLE 8

A balloon fabric, for example of a woven polyester filament yarn fabric or woven nylon-6,6 fabric, is coated with an approximately 0.7 μm thick nickel layer applied by currentless deposition. In addition, it is given a protective coating of PVC, rubber or polyurethane lacquer. This subsequent lamination does not affect the reflective power of the sheet-form material. Line I shows the reflection losses in dB of this fabric when it is only coated with a 0.7 μm thick nickel layer. Line II shows the losses with an additional rubber coating.

| | Frequency range in GHz | | | |
|---|---|---|---|---|
| | 1.9–2.4 | 7–8 | 11–12 | 22–24.5 |
| I | 0.6 | 1.2 | 0.7 | 1.6 |
| II | 0.7 | 1.2 | 0.8 | 1.6 |

A free balloon made of a material such as this may readily be located by the on-board radar of a commercial aircraft.

In the construction of gliders, the fabric may also be embedded as the last layer in polyester resin which increases the radar locatability of gliders.

EXAMPLE 9

The use of metallised laminated fabrics in the rescue field is in accordance with the following A woven polyamide or polyester filament yarn fabric is provided with an approximately 0.65 μm thick nickel layer. Line I of the following Table shows the reflection losses in dB. Lamination with a PVC-coating (line II) or with a polyethylene coating (line III) hardly affects the reflective power of the metallised fabric.

| | Frequecy rage in GHz | | |
|---|---|---|---|
| | 1.8–2.4 | 7–8 | 11–12 |
| I | 0.5 | 0.8 | 0.8 |
| II | 0.5 | 0.5 | 0.8 |
| III | 0.5 | 0.5 | 0.9 |

Life jackets may advantageously be produced from this metallised fabric and may additionally be coated with the prescribed warning paint RAL 2002. The fabric may also be used on rescue islands. When the fabric is applied to the mast tops of sailing boats, the boats are easier to locate by radar without being made top-heavy.

Another advantage of the metallised sheet-form materials is that they may be electrically heated.

We claim:

1. In a method of reflecting microwave and high frequency radiation in the range of from 0.01 to 1000 GHz, the improvement comprising using as a reflecting material, metallised sheet-form textile material composed of synthetic polymers and/or natural fibers with the metal applied after activation thereof with a total metal layer thickness of from 0.02 to 2.5 μm by currentless wet-chemical deposition and varying the degree of polarisation of the reflected radiation by one of monoaxial or bi-axial stretching of the sheet-form textile material.

2. The method according to claim 1, comprising providing the textile material with a mesh width of less than one tenth of the wavelength of the radiation to be reflected.

3. The method according to claim 1, comprising providing an additional electro-deposited metal layer.

4. The method according to claim 1, comprising providing a protective layer on the sheet-form textile material.

5. The method according to claim 1 wherein the stretching is periodic.

6. A reflector for radar waves comprising metallised sheet-form textile material composed of synthetic polymers and/or natural fibers with the metal applied after activation thereof with a total metal layer thickness of from 0.02 to 2.5 μm by currentless wet-chemical deposition and means for at least mono-axially stretching the textile material to vary the degree of polarization of the reflected waves.

7. The reflector according to claim 6, wherein the mesh width of the textile material is less than one tenth of the wavelength of the radiation to be reflected.

8. The reflector according to claim 6, further comprising an additional electro-deposited layer.

9. The reflector according to claim 6, further comprising a protective layer on the sheet-form textile material.

10. The reflector according to claim 6, wherein the stretching is periodic.

* * * * *